US008803628B1

(12) United States Patent
Kroening

(10) Patent No.: US 8,803,628 B1
(45) Date of Patent: Aug. 12, 2014

(54) CIRCULATOR WITH FERRITE ELEMENT ATTACHED TO WAVEGUIDE SIDEWALLS

(71) Applicant: Honeywell International Inc., Morristown, NJ (US)

(72) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/949,668

(22) Filed: Jul. 24, 2013

(51) Int. Cl.
*H01P 1/39* (2006.01)

(52) U.S. Cl.
CPC ..... *H01P 1/39* (2013.01)
USPC ..... 333/1.1

(58) Field of Classification Search
USPC ..... 333/1.1, 24.2
See application file for complete search history.

(56) References Cited

U.S. PATENT DOCUMENTS

| | | | |
|---|---|---|---|
| 5,266,909 | A | 11/1993 | Wolfert |
| 7,683,731 | B2 | 3/2010 | Kroening |
| 8,217,730 | B1 | 7/2012 | Catoiu |

OTHER PUBLICATIONS

Kroening, "Waveguide Circulator With Tapered Matching Component", U.S. Appl. No. 13/588,374, filed Aug. 17, 2012, pp. 1-29.
Kroening, "Waveguide Circulator With Improved Transition to Other Transmission Line Media", U.S. Appl. No. 13/848,242, filed Mar. 21, 2013, pp. 1-52.

*Primary Examiner* — Stephen Jones
(74) *Attorney, Agent, or Firm* — Fogg & Powers LLC

(57) ABSTRACT

A circulator comprises a thermally conductive waveguide housing having a plurality of hollow waveguide arms that communicate with a central cavity, with the hollow waveguide arms each having at least one inner sidewall surface that is angled toward the central cavity. A ferrite element is disposed in the central cavity of the waveguide housing. The ferrite element includes a central portion and a plurality of ferrite segments that extend from the central portion. The ferrite segments each protrude into a separate waveguide arm along the at least one inner sidewall surface, with at least one side of each ferrite segment attached to the at least one inner sidewall surface.

20 Claims, 12 Drawing Sheets

CIRCULATOR WITH FERRITE ELEMENT ATTACHED TO WAVEGUIDE SIDEWALLS

BACKGROUND

Ferrite circulators for waveguides circulate radio frequency (RF) power from one port to another port while absorbing a minimal amount of the circulating power. All of the dielectric and ferrite materials in circulators absorb some power, but the majority of the power absorbed by a ferrite circulator is contained in the ferrite element due to the relatively high volume of the ferrite element, as well as the relatively high electrical and magnetic loss tangents of the ferrite material.

In conventional single junction waveguide circulators, the ferrite temperature rise resulting from the power absorption is primarily dependent on the thermal resistance of the various paths from the ferrite element to the thermally conductive waveguide structure. The waveguide structure acts as a heat sink for the ferrite element, but the thermal paths between these two parts are limited in conventional circulators. These thermal paths flow from the ferrite element through adhesive bonds to either dielectric spacers or quarter-wave dielectric transformers, and on through adhesive bonds to the waveguide structure. The dimensions of the dielectric spacers and quarter-wave dielectric transformers are restricted by RF performance requirements rather than thermal requirements.

Some prior circulators incorporate thermally conductive dielectric attachments in order to maximize the area of contact with the ferrite for improved heat transfer, thereby allowing ferrite circulators to operate at higher average microwave power levels. Nevertheless, increasing average power requirements provide the need for improving the average power handling of ferrite circulators such as switching circulators.

SUMMARY

A circulator comprises a thermally conductive waveguide housing having a plurality of hollow waveguide arms that communicate with a central cavity, with the hollow waveguide arms each having at least one inner sidewall surface that is angled toward the central cavity. A ferrite element is disposed in the central cavity of the waveguide housing. The ferrite element includes a central portion and a plurality of ferrite segments that extend from the central portion. The ferrite segments each protrude into a separate waveguide arm along the at least one inner sidewall surface, with at least one side of each ferrite segment attached to the at least one inner sidewall surface.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

Ferrite circulators for high RF power applications are provided that have enhanced power handling capability. In general, the circulators, which can be switching circulators, include a biased ferrite element disposed in a junction or cavity of a thermally conductive waveguide housing to control the path of RF energy. The ferrite element is offset so that it aligns with a sidewall surface of a waveguide bend in the housing. Selected portions of the ferrite element are directly attached to the sidewall surface to improve thermal conductivity.

The high power handling of a ferrite circulator is limited by the thermal interfaces from the ferrite material to the structure of the waveguide housing. In high power applications, heat is generated in the ferrite material, and this heat needs to be conducted away to keep the junction temperature under control. Typically, heat is conducted to top and bottom waveguide walls (H-plane), either directly or through spacers and transformers. In the present approach, additional heat is removed by the direct attachment of the ferrite element to the sidewalls (E-plane) of the waveguide housing. This decreases the maximum temperature of the ferrite material and associated bond lines under the application of high RF power levels, thus improving the performance and survivability of the ferrite circulator in high RF power applications.

In various embodiments, the waveguide sidewalls where the ferrite element is attached can be angled toward the ferrite junction region. These sidewalls can be angled in a range of about 15-60 degrees, for example. Additional features can also be incorporated into the waveguide housing, such as other angled sidewalls, chamfers, or stepped features, to improve the impedance match into the ferrite element. The other angled sidewalls can be angled toward the ferrite junction region at the same or different angles as the sidewalls where the ferrite element is attached.

The present technique improves the power handling capability of waveguide circulators and waveguide circulator switches. In addition, because of the increased power handling capabilities, the ferrite circulators are suitable for a broader range of applications, making them a viable alternative to other switch technologies, such as mechanical switches, in high average power applications. For example, the present circulators can be employed in high power switching networks for outer space and other high power antenna applications.

Various embodiments of the enhanced ferrite circulator are described hereafter with respect to the drawings.

Figure 1:
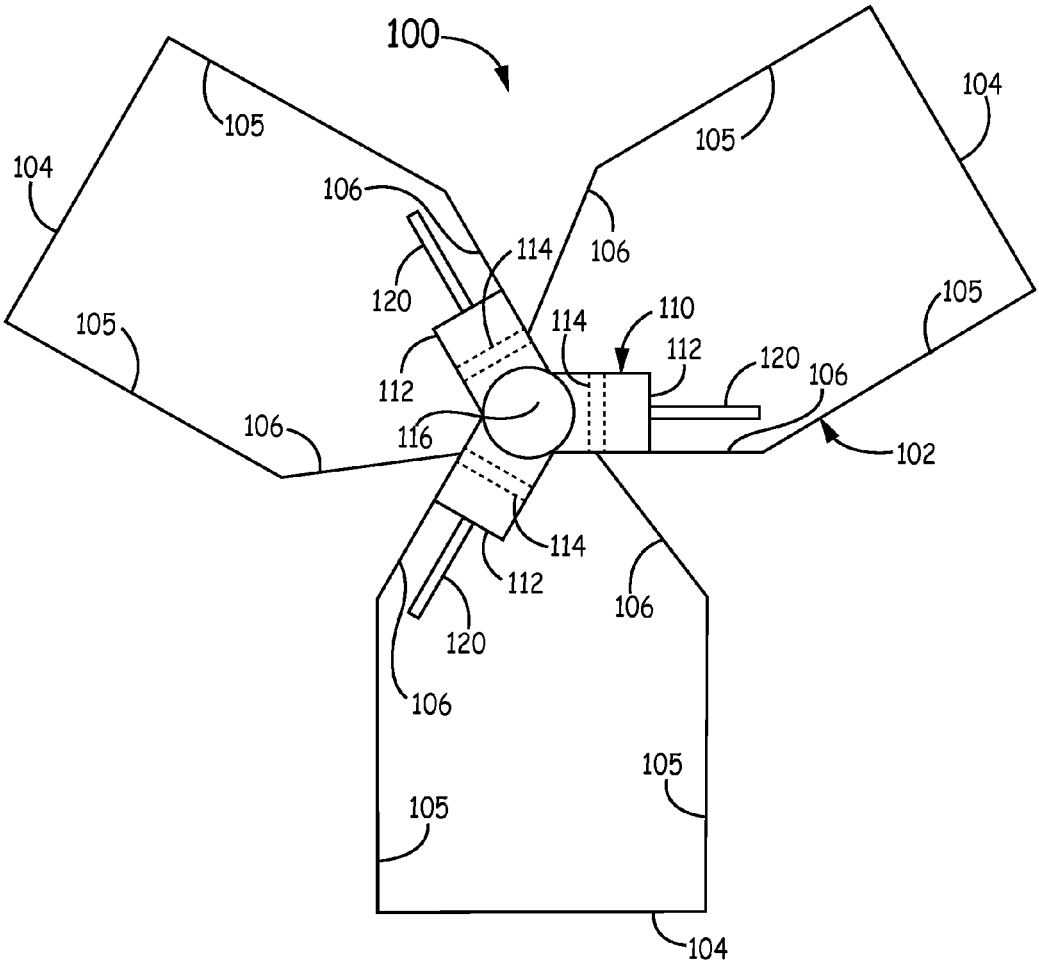
FIG. 1 is a top view of a circulator according to one embodiment.

FIG. 1 illustrates a circulator 100 according to one embodiment. The circulator 100 includes a thermally conductive waveguide housing 102 having a plurality of hollow waveguide arms 104 that are air-filled and have a substantially symmetrical configuration. Each of waveguide arms 104 include a first pair of opposing inner sidewall surfaces 105 that are substantially parallel to each other with substantially the same length. The inner sidewall surfaces 105 transition to a second pair of opposing inner sidewall surfaces 106 that are symmetrically angled toward each other and have substantially the same length. This configuration results in each of waveguide arms 104 narrowing toward a central cavity of waveguide housing 102. The waveguide housing 102 can be composed of a conductive material, such as aluminum, a silver-plated metal, a gold-plated metal, or the like.

A ferrite element 110 is disposed in the central cavity of waveguide housing 102. The ferrite element 110 includes a plurality of ferrite segments 112 that each protrude into a separate waveguide arm 104 along one of sidewall surfaces 106. A side of each ferrite segment 112 is directly attached to a respective sidewall surface 106 of each waveguide arm 104. The direct attachment of each side of ferrite segment 112 to sidewall surfaces 106 can be through an adhesive bond. Alternatively, attachment can be accomplished via a solder bond or other standard attachment methods, which can be used to reduce the thermal resistance of the path from ferrite element 110 to the thermally conductive structure of waveguide housing 102.

As shown in FIG. 1, ferrite element 110 can have a Y-shaped structure with three ferrite segments 112 that respectively extend into three waveguide arms 104. A channel 114 is located in each ferrite segment 112 and can be used to thread a magnetizing winding in order to make ferrite element 110 switchable.

A dielectric spacer 116 is located on an upper surface of ferrite element 110. The dielectric spacer 116 is used to securely position ferrite element 110 in waveguide housing 102, and provides a thermal path out of ferrite element 110 for high power applications. As shown in FIG. 1, dielectric spacer 116 can have a circular shape, for example.

A set of dielectric transformers 120 are respectively attached to a central location of each distal end of ferrite segments 112 and protrude into each waveguide arm 104. The dielectric transformers 120 aid in the transition from ferrite element 110 to the air-filled waveguide arms 104. The dielectric transformers 120 can match the lower impedance of ferrite element 110 to that of the air-filled waveguide arms 104 to reduce signal loss. The dielectric transformers 120 can be standard quarter wave dielectric transformers, for example.

In general, the waveguide arms 104 convey microwave energy into and out of circulator 100 through ferrite element 110. For example, one of waveguide arms 104 can function as an input arm and the other waveguide arms 104 can function as output arms, such that a microwave signal propagates into circulator 100 through the input arm and is transmitted out of circulator 100 through one of the output arms.

Figure 2:
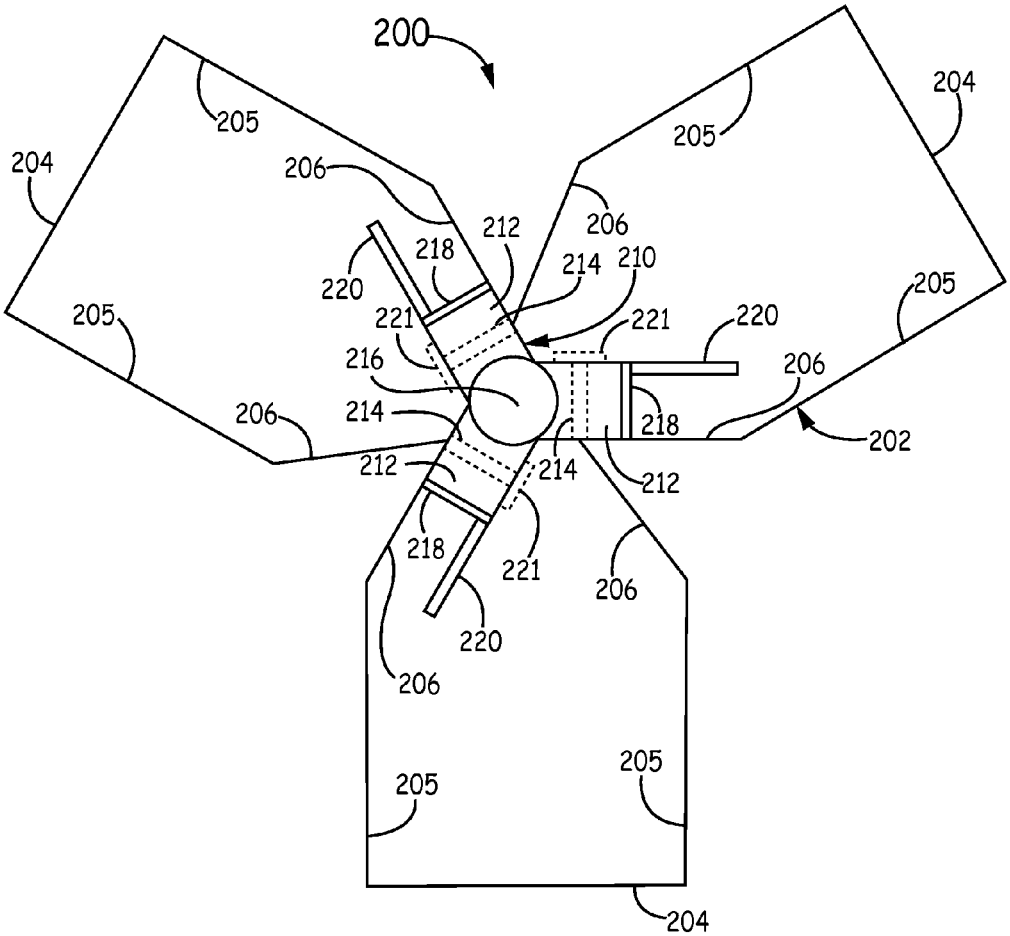
FIG. 2 is a top view of a circulator according to another embodiment.

FIG. 2 illustrates a circulator 200 according to another embodiment. The circulator 200 includes similar components as discussed above for circulator 100. For example, circulator 200 includes a thermally conductive waveguide housing 202, which includes a plurality of hollow waveguide arms 204 that have a substantially symmetrical configuration. Each of waveguide arms 204 include a first pair of opposing inner sidewall surfaces 205 that are substantially parallel to each other, which transition to a second pair of opposing inner sidewall surfaces 206 that are symmetrically angled with respect to each other toward a central cavity of waveguide housing 202.

A ferrite element 210 is disposed in the central cavity of waveguide housing 202. The ferrite element 210 includes a plurality of ferrite segments 212 that each protrude into a separate waveguide arm 204 along one of sidewall surfaces 206. A first side of each ferrite segment 212 is directly attached to a respective sidewall surface 206 of each waveguide arm 204. A channel 214 is located in each ferrite segment 212 and can be used to thread a magnetizing winding to make ferrite element 210 switchable.

A circular-shaped dielectric spacer 216 is located on an upper surface of ferrite element 210. As shown in FIG. 2, dielectric spacer 216 has a larger diameter such that it overhangs the upper surface of ferrite element 210. This configuration for dielectric spacer 216 provides enhanced performance for high power applications.

A thermally conductive dielectric face attachment 218 is coupled to a distal end face of each ferrite segment 212 to provide an additional thermal path to waveguide housing 202. A plurality of dielectric transformers 220 are each respectively attached to face attachments 218 and are offset from a central portion of ferrite element 210. The dielectric transformers 220 extend into each waveguide arm 204 for impedance matching purposes. The dielectric transformers 220 can be standard quarter wave dielectric transformers, for example. In another embodiment, each face attachment 218 and transformer 220 can be combined into a single face attachment/transformer assembly, as both can be made of the same thermally conductive dielectric materials. Suitable thermally conductive dielectric materials include boron nitride, aluminum nitride, and beryllium oxide, for example.

In an optional embodiment, a plurality of thermally conductive dielectric side attachments 221 can be added to the sides of ferrite segments 212 opposite from the sides directly attached to sidewall surfaces 206 of waveguide arms 204. The dielectric side attachments 221 provide additional thermal paths for removal of heat from ferrite element 210.

Figure 3A:
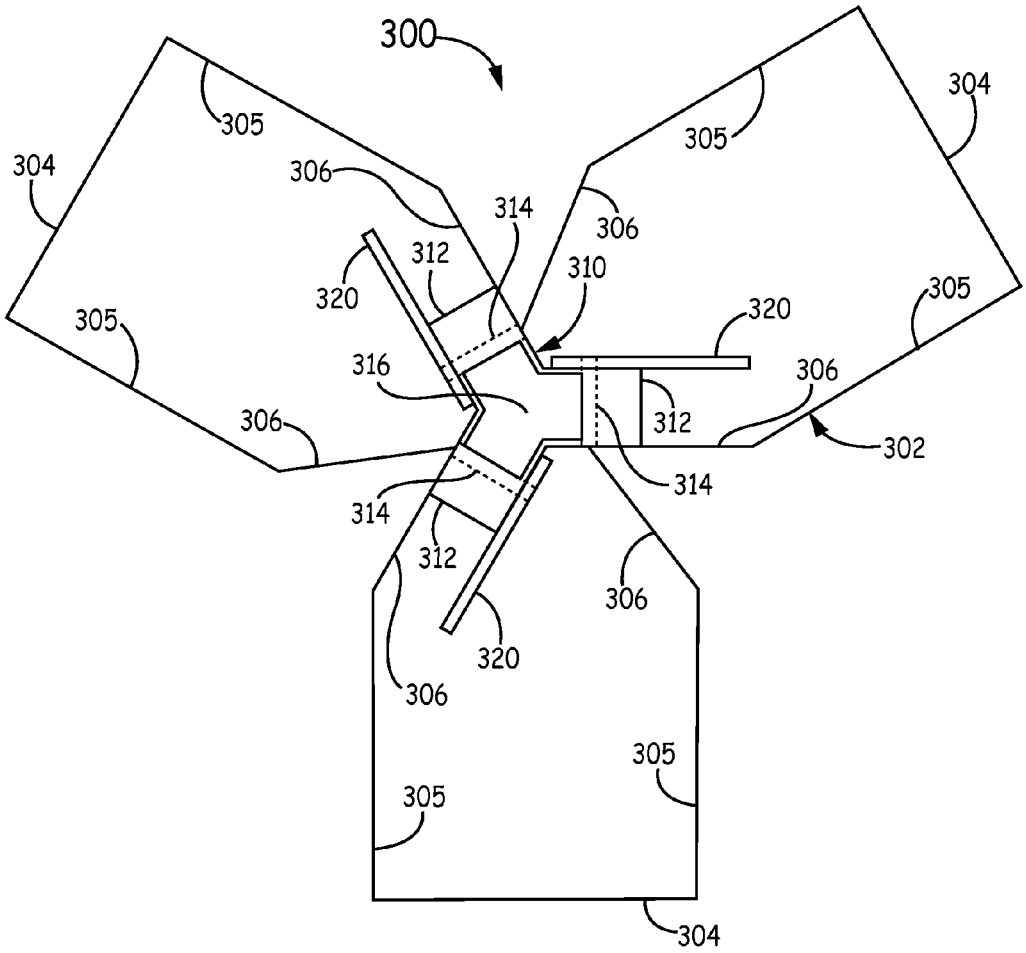
FIG. 3A is a top view of a circulator according a further embodiment.
Figure 3B:
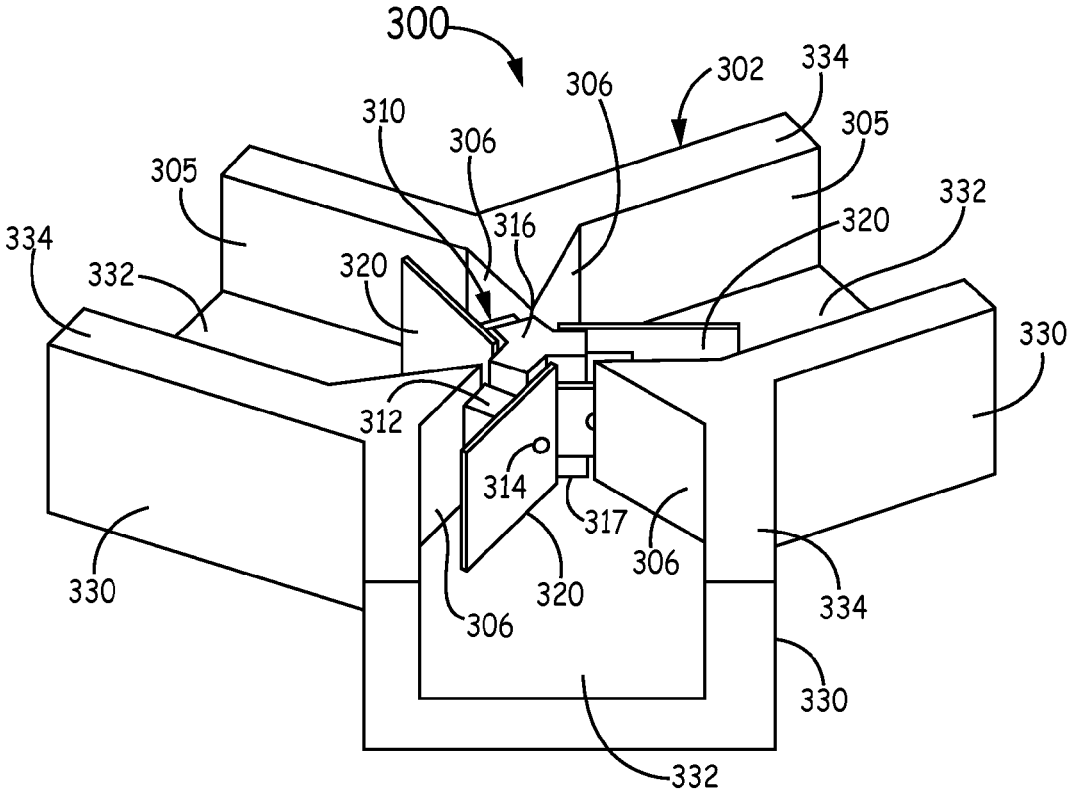
FIG. 3B is an isometric view of the circulator of FIG. 3A.

FIGS. 3A and 3B illustrate a circulator 300 according to a further embodiment. The circulator 300 includes similar components as discussed above for circulator 100. For example, circulator 300 includes a thermally conductive waveguide housing 302, which includes a plurality of hollow waveguide arms 304 that have a substantially symmetrical configuration. Each of waveguide arms 304 include a first pair of opposing inner sidewall surfaces 305 that are substantially parallel to each other, which transition to a second pair of opposing inner sidewall surfaces 306 that are symmetrically angled with respect to each other toward a central cavity of waveguide housing 302.

A ferrite element 310 is disposed in the central cavity of waveguide housing 302. The ferrite element 310 includes a plurality of ferrite segments 312 that each protrude into a separate waveguide arm 304 along one of sidewall surfaces 306. A first side of each ferrite segment 312 is attached to a respective sidewall surface 306 of each waveguide arm 304. A channel 314 is located in each ferrite segment 312 and can be used to thread a magnetizing winding to make ferrite element 310 switchable.

A first dielectric spacer 316 is attached to an upper surface of ferrite element 310. As shown in FIG. 3A, dielectric spacer 316 can have a Y-shaped structure similar to the shape of ferrite element 310.

A set of dielectric transformers 320 are each respectively attached to a second side of ferrite segments 312 opposite from the first side of ferrite segments 312 attached to inner sidewall surfaces 306. The dielectric transformers 320 extend into each waveguide arm 304 offset from a central portion of ferrite element 310, which provides improved impedance matching performance. The portions of dielectric transformers 320 that are attached to ferrite segments 312 provide additional thermal paths for removal of heat from ferrite element 310. The dielectric transformers 320 can be standard quarter wave dielectric transformers, for example.

FIG. 3B is an isometric view that illustrates further aspects of circulator 300. In particular, further details of waveguide housing 302 are depicted, including a plurality of conductive side walls 330 and a conductive floor 332. A cover is typically attached to upper surfaces 334 of waveguide housing 302, but is removed in the illustrated embodiment to show the underlying structures. The conductive sidewalls 330 define the shape of the hollow passages in waveguide housing 302 through inner sidewall surfaces 305 and 306. FIG. 3B also shows a second dielectric spacer 317 that is mounted on conductive floor 332. The dielectric spacer 317 supports ferrite element 310 in a raised position above conductive floor 332.

The structure of waveguide housing 302 illustrated in FIG. 3B can also be implemented for circulators 100 and 200 described above, since inner sidewall surfaces 105, 106 of waveguide housing 102 (FIG. 1) and inner sidewall surfaces 205, 206 of waveguide housing 202 (FIG. 2) have the same configuration as inner sidewall surfaces 305, 306 of waveguide housing 302.

Figure 4:
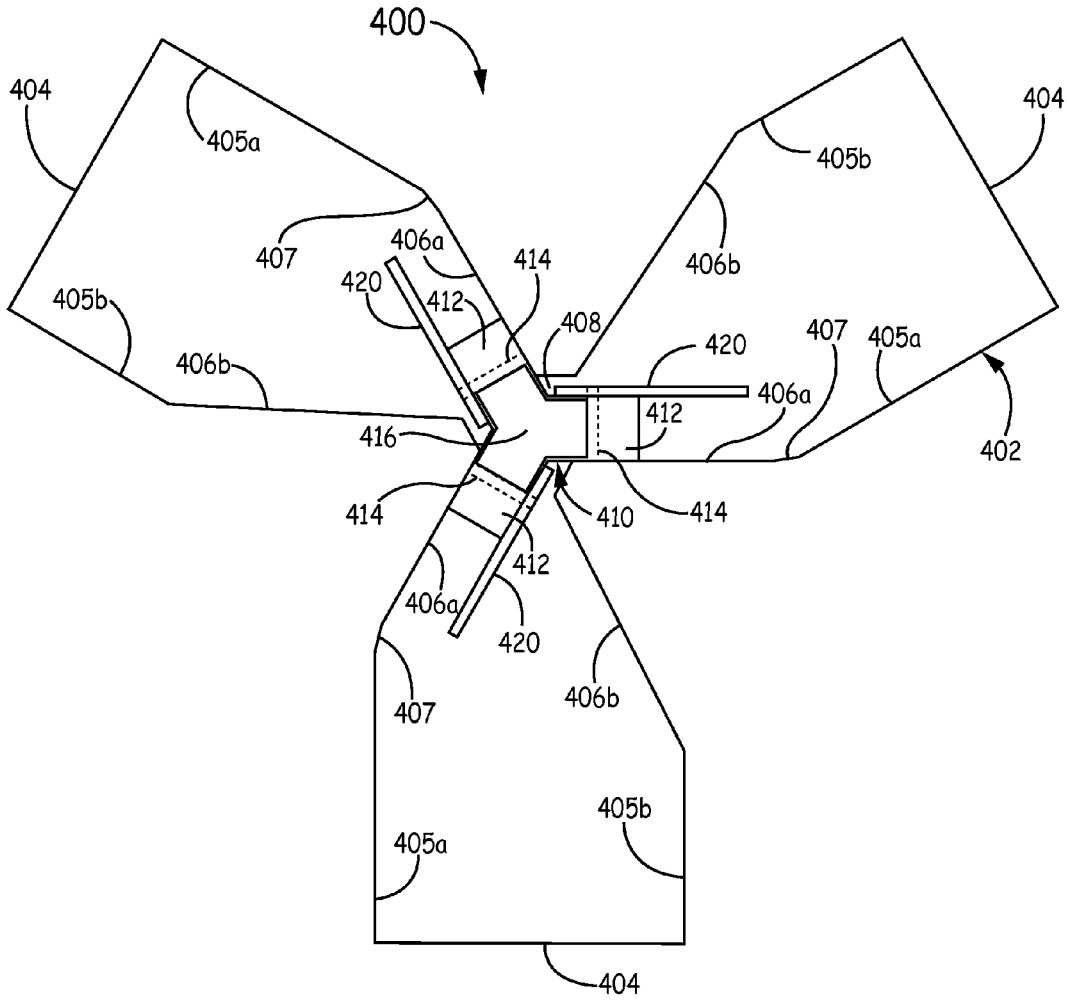
FIG. 4 is a top view of a circulator according to an alternative embodiment.

FIG. 4 depicts a circulator 400 according to an alternative embodiment, which includes similar internal components as circulator 300, but has a different configuration for a thermally conductive waveguide housing 402. In particular, waveguide housing 402 includes a plurality of hollow waveguide arms 404, but which have an asymmetrical configuration. Accordingly, waveguide arms 404 each include a first pair of opposing inner sidewall surfaces 405*a* and 405*b* that are substantially parallel to each other but have different lengths. A second pair of opposing inner sidewall surfaces 406*a* and 406*b* are asymmetrically angled with respect to each other toward a central cavity of waveguide housing 402 and have different lengths. A chamfer 407 extends between sidewall surfaces 405*a* and 406*a*.

A ferrite element 410 is disposed in a central cavity 408 of waveguide housing 402, and includes a plurality of ferrite segments 412. Each of ferrite segments 412 protrude into a separate waveguide arm 404 along inner sidewall surfaces 406*a*, with a first side of each ferrite segment 412 attached to a respective sidewall surface 406*a* of each waveguide arm 404. A channel 414 is located in each ferrite segment 412 and can be used to thread a magnetizing winding to make ferrite element 410 switchable. A dielectric spacer 416 is attached to an upper surface of ferrite element 410.

Three dielectric transformers 420 are each respectively attached to a second side of ferrite segments 412 opposite from the first side of ferrite segments 412 attached to inner sidewall surfaces 406*a*. The dielectric transformers 420 can be standard quarter wave dielectric transformers, for example.

Figure 5:
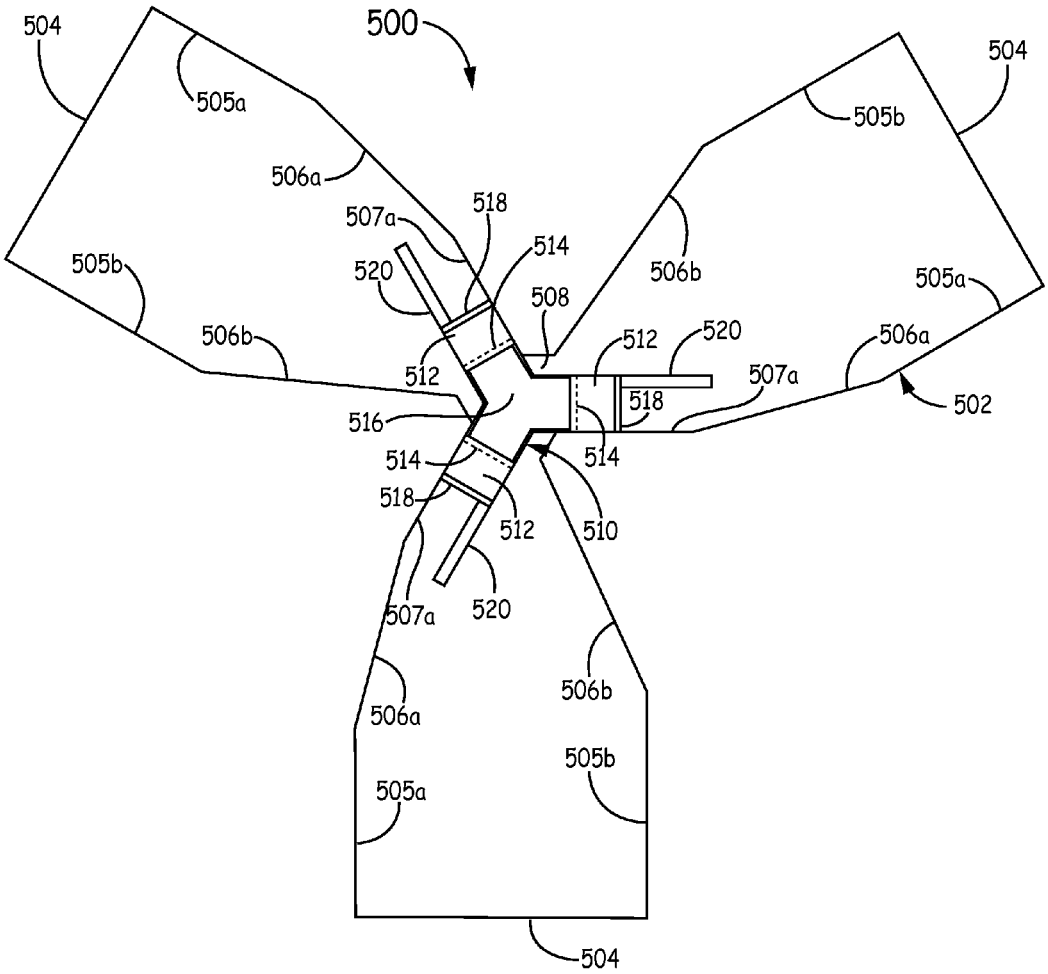
FIG. 5 is a top view of a circulator according to another embodiment.

FIG. 5 depicts a circulator 500 according to another embodiment, which includes similar internal components as circulator 400, but has an alternate configuration for a thermally conductive waveguide housing 502. In particular, waveguide housing 502 includes a plurality of hollow waveguide arms 504 that have an asymmetrical configuration. Accordingly, waveguide arms 504 each include a first pair of opposing inner sidewall surfaces 505*a* and 505*b* that are substantially parallel to each other but and have different lengths. The sidewall surface 505*a* transitions to a first angled sidewall surface 506*a*, which in turn transitions to a second angled sidewall surface 507*a*. Sidewall 505*b* transitions to an angled sidewall surface 506*b*.

A ferrite element 510 is disposed in a central cavity 508 of waveguide housing 502, and includes a plurality of ferrite segments 512. Each of ferrite segments 512 protrude into a separate waveguide arm 504 along inner sidewall surfaces 507*a*, with one side of each ferrite segment 512 attached to a respective sidewall surface 507*a* of each waveguide arm 504. A channel 514 is located in each ferrite segment 512 and can be used to thread a magnetizing winding to make ferrite element 510 switchable. A dielectric spacer 516 is attached to an upper surface of ferrite element 510.

A thermally conductive dielectric face attachment 518 is coupled to a distal end face of each ferrite segment 512 to provide an additional thermal path to waveguide housing 502. A plurality of dielectric transformers 520 are each respectively attached to face attachments 518 and are offset from a central portion of ferrite element 510. The dielectric transformers 520 extend into each waveguide arm 504 for impedance matching purposes. The dielectric transformers 520 can be standard quarter wave dielectric transformers, for example.

Figure 6A:
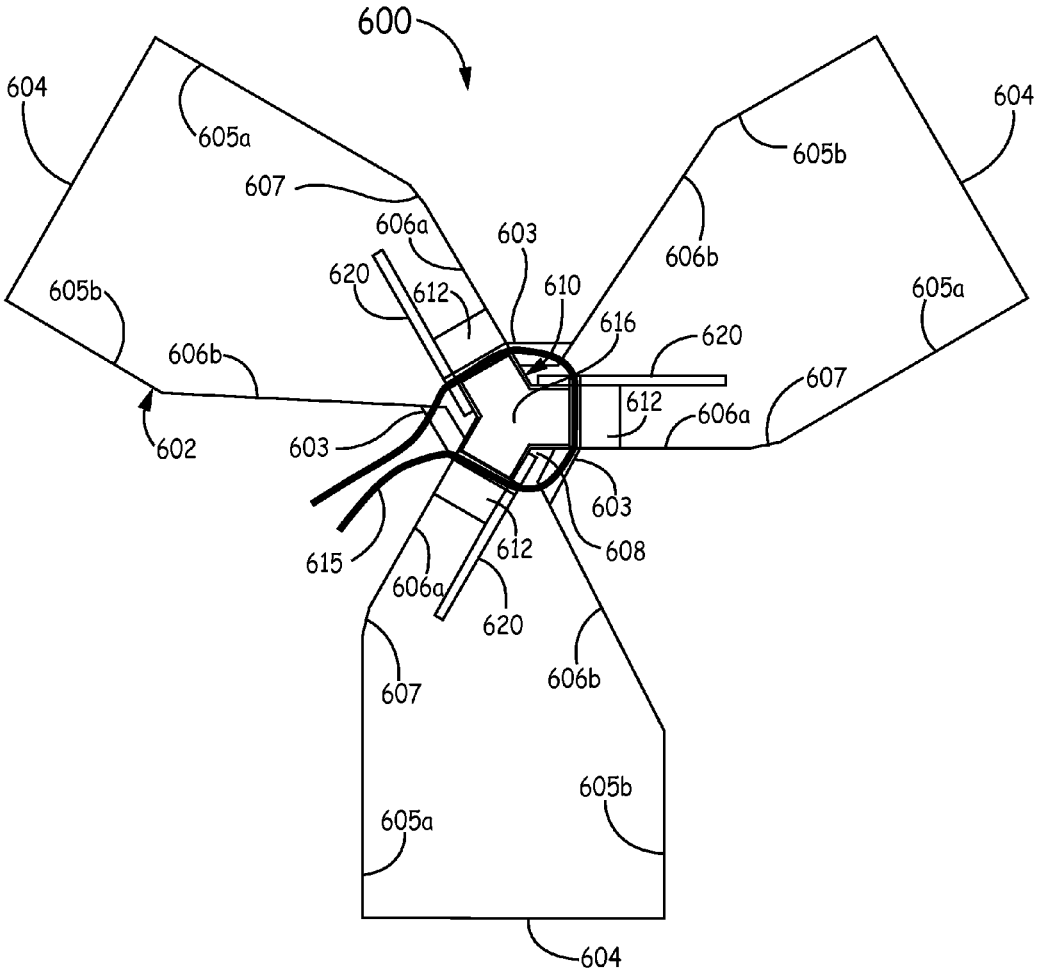
FIG. 6A is a top view of a circulator according to a further embodiment.
Figure 6B:
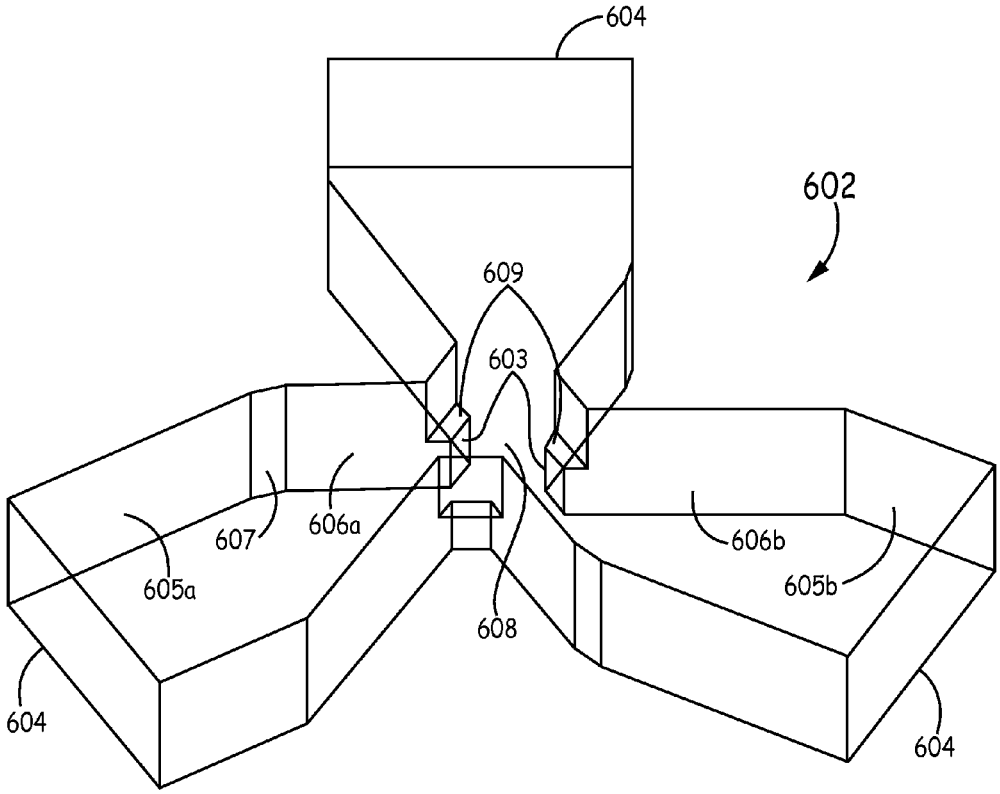
FIG. 6B is an isometric view of a waveguide housing for the circulator of FIG. 6A.
Figure 6C:
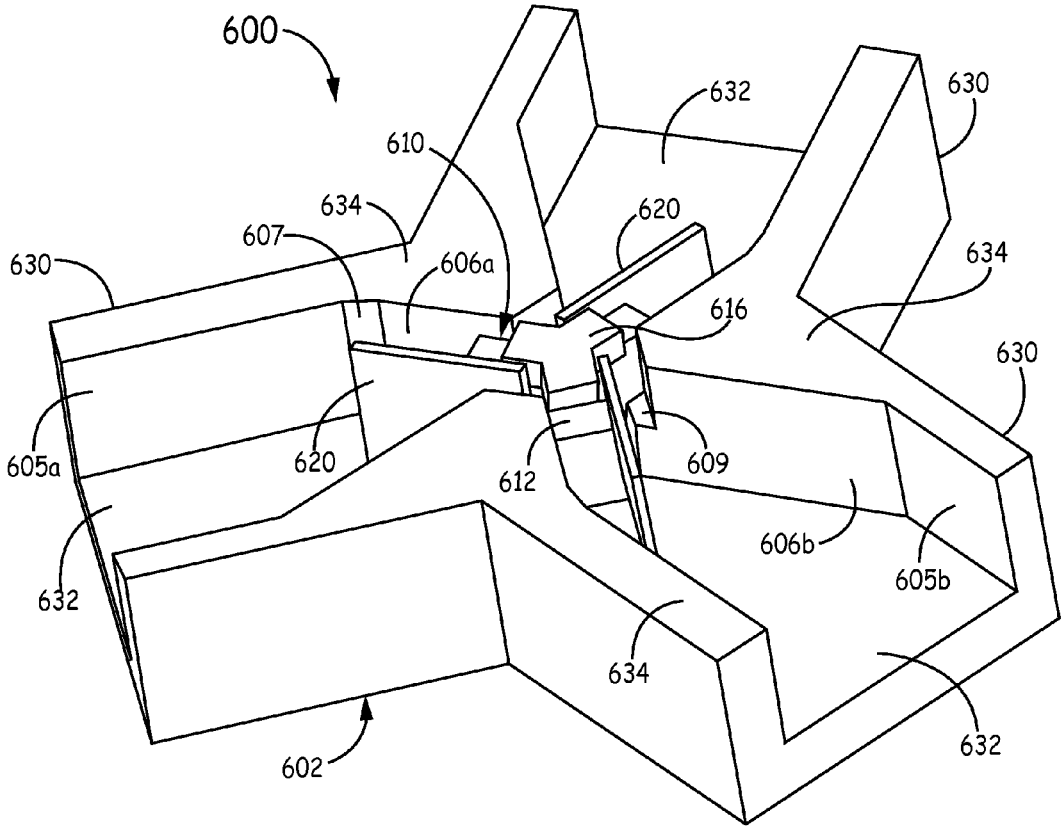
FIG. 6C is an isometric view illustrating further aspects of the circulator of FIG. 6A.

FIGS. 6A-6C illustrate various aspects of a circulator 600 according to another embodiment, which includes similar components as circulator 400, but has an alternate configuration for a thermally conductive waveguide housing 602. In particular, waveguide housing 602 includes a plurality of hollow waveguide arms 604 that have an asymmetrical configuration. Accordingly, waveguide arms 604 each include a first pair of opposing inner sidewall surfaces 605*a* and 605*b* that are substantially parallel to each other but and have different lengths. A second pair of opposing inner sidewall surfaces 606*a* and 606*b* are asymmetrically angled with respect to each other toward a central cavity of waveguide housing 602 and have different lengths. A chamfer 607 extends between sidewall surfaces 605*a* and 606*a*.

A ferrite element 610 is disposed in a central cavity 608 of waveguide housing 602, and includes a plurality of ferrite segments 612. Each of ferrite segments 612 protrude into a separate waveguide arm 604 along inner sidewall surfaces 606*a*, with a first side of each ferrite segment 612 attached to a respective sidewall surface 606*a* of each waveguide arm 604. A dielectric spacer 616 is attached to an upper surface of ferrite element 610.

Three dielectric transformers 620 are each respectively attached to a second side of ferrite segments 612 opposite from the first side of ferrite segments 612 attached to inner sidewall surfaces 606*a*. The dielectric transformers 620 can be standard quarter wave dielectric transformers, for example.

The waveguide housing 602 further includes support structures 603 that allow ferrite element 610 to be wired with a control wire 615, such as a magnetized winding, without the wire exiting cavity 608 between ferrite segments 612. FIG. 6B is an isometric view of waveguide housing 602, without the ferrite element, showing further details of support structures 603. Each of support structures 603 has a raised step 609 for supporting the wire within cavity 608.

FIG. 6C is an isometric view that illustrates further aspects of circulator 600, but without the control wire. In particular, further details of waveguide housing 602 are depicted, including a plurality of conductive side walls 630 and a conductive floor 632. A cover is typically attached to upper surfaces 634 of waveguide housing 602, but is removed in the illustrated embodiment to show the underlying structures. The conductive sidewalls 630 define the shape of the hollow passages in waveguide housing 602 through inner sidewall surfaces 605*a*, 606*a*, and inner sidewall surfaces 605*b*, 606*b*.

When a current pulse is applied to control wire 615, ferrite element 610 is latched into a certain magnetization. By switching the polarity of the current pulse applied to control wire 615, the signal flow direction in circulator 600 can be switched from one waveguide arm 604 to another waveguide arm 604.

Figure 7A:
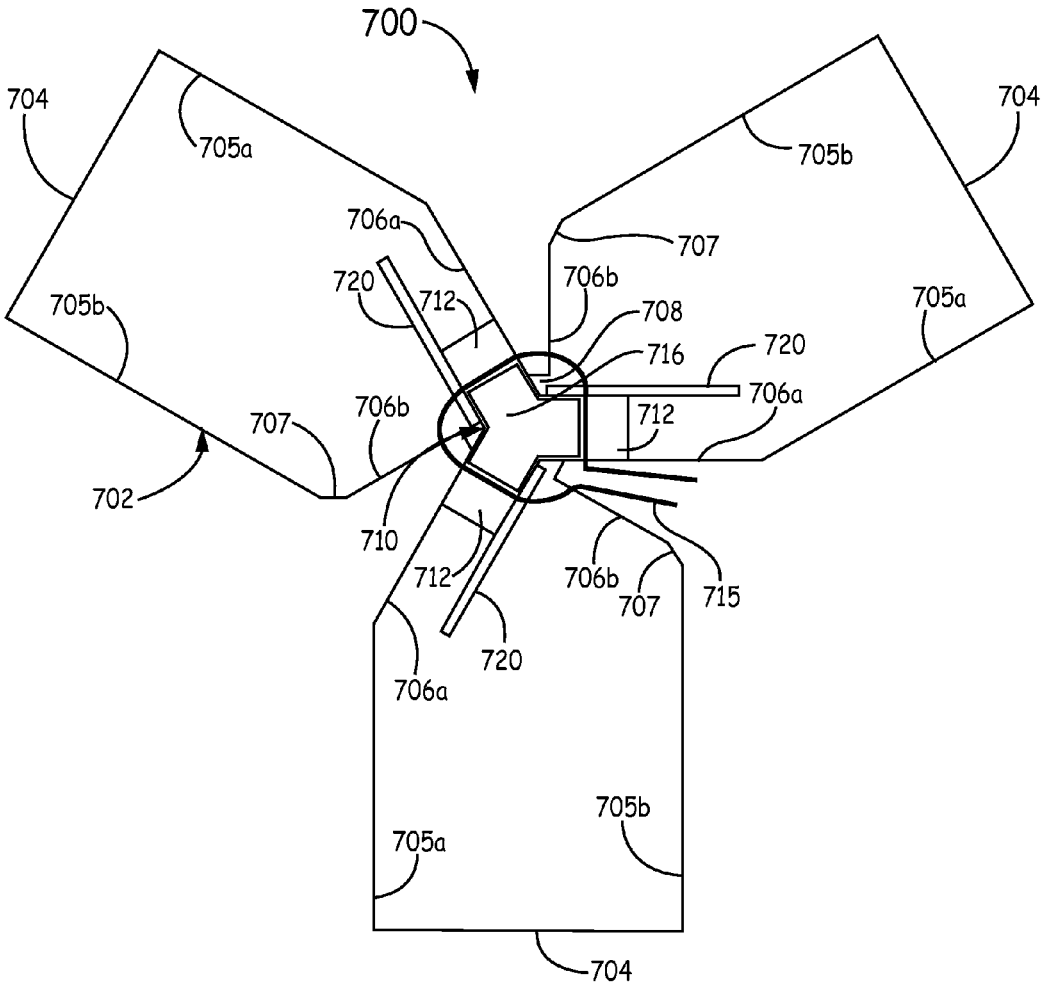
FIG. 7A is a top view of a circulator according to another alternative embodiment.
Figure 7B:
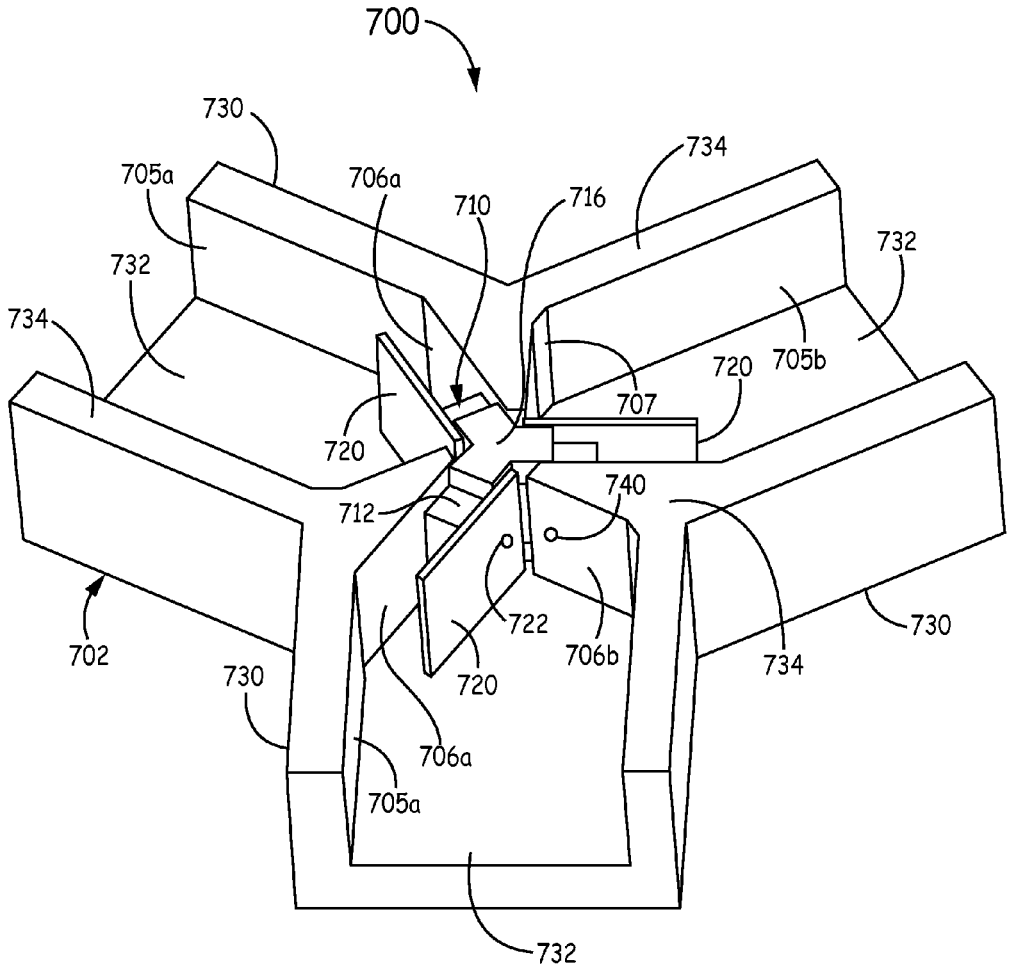
FIG. 7B is an isometric view illustrating further aspects of the circulator of FIG. 7A.
Figure 7C:
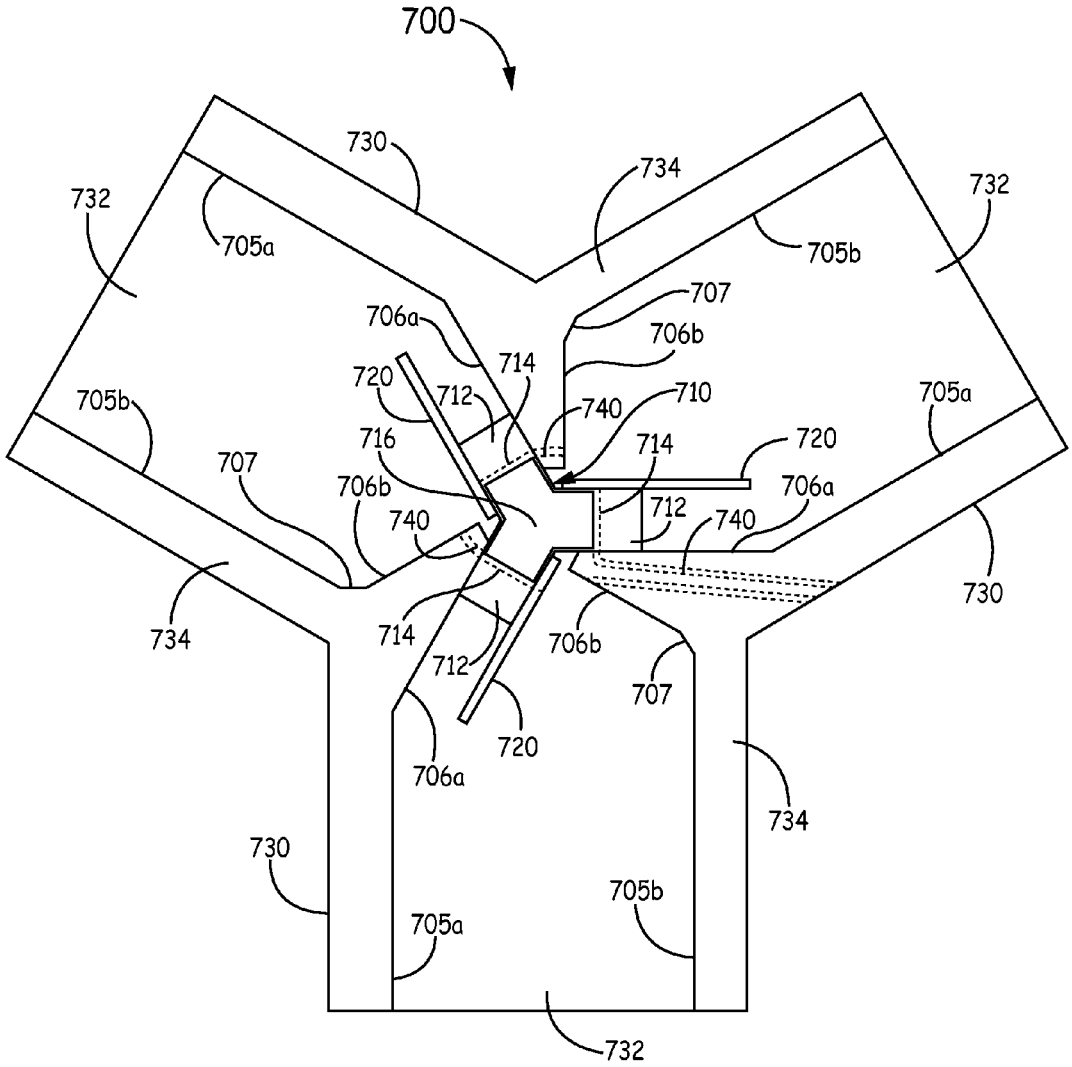
FIG. 7C is a top view illustrating further aspects of the circulator of FIG. 7A.

FIGS. 7A-7C illustrate various aspects of a circulator 700 according to a further embodiment, which includes similar components as circulator 600, but has an alternate configuration for a thermally conductive waveguide housing 702. In particular, waveguide housing 702 includes a plurality of hollow waveguide arms 704 that have an asymmetrical configuration. Accordingly, waveguide arms 704 each include a first pair of opposing inner sidewall surfaces 705*a* and 705*b* that are substantially parallel to each other but and have different lengths. A second pair of opposing inner sidewall surfaces 706*a* and 706*b* are asymmetrically angled toward a central cavity of waveguide housing 702 and have different lengths. A chamfer 707 extends between sidewall surfaces 705*b* and 706*b*.

A ferrite element 710 is disposed in a central cavity 708 of waveguide housing 702, and includes a plurality of ferrite segments 712. Each of ferrite segments 712 protrude into a separate waveguide arm 704 along inner sidewall surfaces 706*a*, with a first side of each ferrite segment 712 attached to a respective sidewall surface 706*a* of each waveguide arm 704. A dielectric spacer 716 is attached to an upper surface of ferrite element 710.

Three dielectric transformers 720 are each respectively attached to a second side of ferrite segments 712 opposite from the first side of ferrite segments 712 attached to inner sidewall surfaces 706*a*. The dielectric transformers 720 can be standard quarter wave dielectric transformers, for example. A channel 714 located in each ferrite segment 712 communicates with an opening 722 through each of dielectric transformers 720, allowing for threading a control wire 715, such as a magnetizing winding, to make ferrite element 710 switchable. The configuration of waveguide arms 704 allow ferrite element 710 to be wired such that control wire 715 exits cavity 708 between each of ferrite segments 712, as shown in FIG. 7A. This configuration maximizes the area and thermal conductivity between ferrite element 710 and waveguide housing 702.

FIGS. 7B and 7C illustrate further aspects of circulator 700, but without the control wire. In particular, further details of waveguide housing 702 are depicted, including a plurality of conductive side walls 730 and a conductive floor 732. A cover is typically attached to upper surfaces 734 of waveguide housing 702, but is removed to show the underlying structures. The conductive sidewalls 730 define the shape of the hollow passages in waveguide housing 702 through inner sidewall surfaces 705*a*, 706*a*, and inner sidewall surfaces 705*b*, 706*b*. In addition, conductive sidewalls 730 have channels 740 that communicate with channels 714, which allows for threading of the control wire through conductive sidewalls 730 that are between each ferrite segment 712.

When a current pulse is applied to control wire 715, ferrite element 710 is latched into a certain magnetization. By switching the polarity of the current pulse applied to control wire 715, the signal flow direction in circulator 700 can be switched from one waveguide arm 704 to another waveguide arm 704.

Example Embodiments

Example 1 includes a circulator comprising a thermally conductive waveguide housing having a plurality of hollow waveguide arms that communicate with a central cavity, the hollow waveguide arms each having at least one inner sidewall surface that is angled toward the central cavity; and a ferrite element disposed in the central cavity of the waveguide housing, the ferrite element including a central portion and a plurality of ferrite segments that extend from the central portion, the ferrite segments each protruding into a separate waveguide arm along the at least one inner sidewall surface, wherein at least one side of each ferrite segment is attached to the at least one inner sidewall surface.

Example 2 includes the circulator of Example 1, wherein the waveguide housing has a substantially symmetrical configuration such that each of the waveguide arms further comprises a first pair of opposing inner sidewall surfaces that are substantially parallel to each other, and a second pair of opposing inner sidewall surfaces that are angled toward each other and include the at least one inner sidewall surface where the ferrite segment is attached.

Example 3 includes the circulator of Example 1, wherein the waveguide housing has an asymmetrical configuration such that each of the waveguide arms further include a first pair of opposing inner sidewall surfaces that are substantially parallel to each other but have different lengths, and a second pair of opposing inner sidewall surfaces that are asymmetrically angled toward each other with different lengths and include the at least one inner sidewall surface where the ferrite segment is attached Example 4 includes the circulator of Example 3, wherein the waveguide housing further comprises a plurality of support structures adjacent to the central cavity, wherein the support structures allow the ferrite element to be wired with a control wire without the control wire exiting the central cavity between the ferrite segments.

Example 5 includes the circulator of Example 4, wherein the support structures each have a raised step for supporting the control wire within the central cavity.

Example 6 includes the circulator of any of Examples 1 and 3, wherein the waveguide arms are configured to allow the ferrite element to be wired with a control wire that exits the central cavity between each of the ferrite segments.

Example 7 includes the circulator of any of Examples 1-6, further comprising a plurality of dielectric transformers each respectively attached to one of the ferrite segments, wherein the dielectric transformers protrude into each waveguide arm away from the central cavity.

Example 8 includes the circulator of Example 7, wherein the dielectric transformers are each centrally attached to a distal end of the ferrite segments and in alignment with the central portion of the ferrite element.

Example 9 includes the circulator of Example 7, wherein the dielectric transformers are each attached to a distal end of the ferrite segments and offset from the central portion of the ferrite element.

Example 10 includes the circulator of Example 7, wherein the dielectric transformers are each respectively attached to a side of the ferrite segments opposite from the side of the ferrite segments attached to the inner sidewall surface, the dielectric transformers offset from the central portion of the ferrite element.

Example 11 includes the circulator of any of Examples 1-10, wherein the waveguide housing includes three waveguide arms.

Example 12 includes the circulator of Example 11, wherein the ferrite element has a Y-shaped structure that includes three ferrite segments that each respectively extend into one of the three waveguide arms.

Example 13 includes the circulator of any of Examples 1-12, wherein each ferrite segment includes a channel for threading a control wire through the ferrite element.

Example 14 includes the circulator of any of Examples 1-13, further comprising a magnetizing winding disposed in the ferrite element.

Example 15 includes the circulator of any of Examples 1-14, further comprising a first dielectric spacer located on an upper surface of the central portion of the ferrite element.

Example 16 includes the circulator of Example 15, further comprising a second dielectric spacer located on a lower surface of the central portion of the ferrite element.

Example 17 includes the circulator of any of Examples 1-16, wherein the at least one side of each ferrite segment is attached to the at least one sidewall surface with an adhesive bond or a solder bond.

Example 18 includes a switching waveguide circulator comprising a thermally conductive waveguide housing having a plurality of hollow waveguide arms that communicate with a central cavity, the hollow waveguide arms each having at least one inner sidewall surface that is angled toward the central cavity; a ferrite element disposed in the central cavity of the waveguide housing, the ferrite element including a central portion and a plurality of ferrite segments that extend from the central portion, the ferrite segments each protruding into a separate waveguide arm along the angled inner sidewall surface, wherein a first side of each ferrite segment is attached to the angled inner sidewall surface; a plurality of dielectric transformers each respectively attached to a second side of the ferrite segments opposite from the first side of the ferrite segments and offset from the central portion of the ferrite element, wherein the dielectric transformers protrude into each waveguide arm away from the central cavity; and a control wire threaded through the ferrite segments and the dielectric transformers; wherein the waveguide arms are configured to allow the control wire to exit the central cavity of the waveguide housing between each of the ferrite segments.

Example 19 includes the switching waveguide circulator of Example 18, wherein the waveguide housing has an asymmetrical configuration such that each of the waveguide arms further include a first pair of opposing inner sidewall surfaces that are substantially parallel to each other but have different lengths, and a second pair of opposing inner sidewall surfaces that are asymmetrically angled toward each other with different lengths and include the inner sidewall surface where the ferrite segment is attached.

Example 20 includes the switching waveguide circulator of any of Examples 18-19, wherein the first side of each ferrite segment is attached to the angled inner sidewall surface with an adhesive bond or a solder bond.

The present invention may be embodied in other forms without departing from its essential characteristics. The described embodiments are to be considered in all respects only as illustrative and not restrictive. Therefore, it is intended that this invention be limited only by the claims and the equivalents thereof.

What is claimed is:

1. A circulator, comprising:

a thermally conductive waveguide housing having a plurality of hollow waveguide arms that communicate with a central cavity, the hollow waveguide arms each having at least one inner sidewall surface that is angled toward the central cavity; and a ferrite element disposed in the central cavity of the waveguide housing, the ferrite element including a central portion and a plurality of ferrite segments that extend from the central portion, the ferrite segments each protruding into a separate waveguide arm along the at least one inner sidewall surface, wherein at least one side of each ferrite segment is attached to the at least one inner sidewall surface.

2. The circulator of claim 1, wherein the waveguide housing has a substantially symmetrical configuration such that each of the waveguide arms further comprises a first pair of opposing inner sidewall surfaces that are substantially parallel to each other, and a second pair of opposing inner sidewall surfaces that are angled toward each other and include the at least one inner sidewall surface where the ferrite segment is attached.

3. The circulator of claim 1, wherein the waveguide arms are configured to allow the ferrite element to be wired with a control wire that exits the central cavity between each of the ferrite segments.

4. The circulator of claim 1, further comprising a magnetizing winding disposed in the ferrite element.

5. The circulator of claim 1, wherein the at least one side of each ferrite segment is attached to the at least one sidewall surface with an adhesive bond or a solder bond.

6. The circulator of claim 1, further comprising a first dielectric spacer located on an upper surface of the central portion of the ferrite element.

7. The circulator of claim 6, further comprising a second dielectric spacer located on a lower surface of the central portion of the ferrite element.

8. The circulator of claim 1, wherein the waveguide housing has an asymmetrical configuration such that each of the waveguide arms further include a first pair of opposing inner sidewall surfaces that are substantially parallel to each other but have different lengths, and a second pair of opposing inner sidewall surfaces that are asymmetrically angled toward each other with different lengths and include the at least one inner sidewall surface where the ferrite segment is attached.

9. The circulator of claim 8, wherein the waveguide housing further comprises a plurality of support structures adjacent to the central cavity, wherein the support structures allow the ferrite element to be wired with a control wire without the control wire exiting the central cavity between the ferrite segments.

10. The circulator of claim 9, wherein the support structures each have a raised step for supporting the control wire within the central cavity.

11. The circulator of claim 1, wherein the waveguide housing includes three waveguide arms.

12. The circulator of claim 11, wherein the ferrite element has a Y-shaped structure that includes three ferrite segments that each respectively extend into one of the three waveguide arms.

13. The circulator of claim 12, wherein each ferrite segment includes a channel for threading a control wire through the ferrite element.

14. The circulator of claim 1, further comprising a plurality of dielectric transformers each respectively attached to one of the ferrite segments, wherein the dielectric transformers protrude into each waveguide arm away from the central cavity.

15. The circulator of claim 14, wherein the dielectric transformers are each centrally attached to a distal end of the ferrite segments and in alignment with the central portion of the ferrite element.

16. The circulator of claim 14, wherein the dielectric transformers are each attached to a distal end of the ferrite segments and offset from the central portion of the ferrite element.

17. The circulator of claim 14, wherein the dielectric transformers are each respectively attached to a side of the ferrite segments opposite from the side of the ferrite segments attached to the inner sidewall surface, the dielectric transformers offset from the central portion of the ferrite element.

18. A switching waveguide circulator, comprising:

a thermally conductive waveguide housing having a plurality of hollow waveguide arms that communicate with a central cavity, the hollow waveguide arms each having at least one inner sidewall surface that is angled toward the central cavity;

a ferrite element disposed in the central cavity of the waveguide housing, the ferrite element including a central portion and a plurality of ferrite segments that extend from the central portion, the ferrite segments each protruding into a separate waveguide arm along the angled inner sidewall surface, wherein a first side of each ferrite segment is attached to the angled inner sidewall surface;

a plurality of dielectric transformers each respectively attached to a second side of the ferrite segments opposite from the first side of the ferrite segments and offset from the central portion of the ferrite element, wherein the dielectric transformers protrude into each waveguide arm away from the central cavity; and a control wire threaded through the ferrite segments and the dielectric transformers;

wherein the waveguide arms are configured to allow the control wire to exit the central cavity of the waveguide housing between each of the ferrite segments.

19. The switching waveguide circulator of claim 18, wherein the waveguide housing has an asymmetrical configuration such that each of the waveguide arms further include a first pair of opposing inner sidewall surfaces that are substantially parallel to each other but have different lengths, and a second pair of opposing inner sidewall surfaces that are asymmetrically angled toward each other with different lengths and include the inner sidewall surface where the ferrite segment is attached.

20. The switching waveguide circulator of claim 18, wherein the first side of each ferrite segment is attached to the angled inner sidewall surface with an adhesive bond or a solder bond.

* * * * *